US006116085A

United States Patent [19]

Moffatt et al.

[11] Patent Number: 6,116,085

[45] Date of Patent: Sep. 12, 2000

[54] INSTRUMENTATION TUBING STRING ASSEMBLY FOR USE IN WELLBORES

[75] Inventors: Terry George Moffatt, Cochrane; Richard John Chalaturnyk, St. Albert; Harbir Singh Chhina, Calgary, all of Canada

[73] Assignees: AEC East; Promore Engineering Inc., both of Calvary, Canada

[21] Appl. No.: 09/094,128

[22] Filed: Jun. 9, 1998

[51] Int. Cl.[7] ..... E21B 47/06; E21B 47/00

[52] U.S. Cl. ..... 73/152.46; 73/152.18; 73/152.52; 166/250.11; 166/250.01

[58] Field of Search ..... 73/152.51, 152.52, 73/152.46, 152.54, 152.02, 152.18; 166/250.01, 250.11, 254.2, 380

[56] References Cited

U.S. PATENT DOCUMENTS

| | | | |
|---|---|---|---|
| 3,627,065 | 12/1971 | Murphy | 73/152.46 |
| 4,359,899 | 11/1982 | Claycomb | 73/152.51 |
| 4,553,428 | 11/1985 | Upchurch | 73/152.52 |
| 4,741,208 | 5/1988 | Vandevier | 73/152.52 |
| 5,010,764 | 4/1991 | Taylor | 73/152.51 |
| 5,350,018 | 9/1994 | Sorem et al. | 73/152.52 |
| 5,826,654 | 10/1998 | Adnan et al. | 73/152.52 |

*Primary Examiner*—Hezron Williams
*Assistant Examiner*—J. David Wiggins
*Attorney, Agent, or Firm*—Dennis T. Griggs

[57] ABSTRACT

A coil of continuous steel tubing string is stretched along the ground. An elongate bundle of instrument lines, including thermocouples and pressure sensor wiring, is threaded into the bore of the tubing string. The instrument lines are landed at multiple spaced apart measurement points along the string. The string and the contained bundle are cut at pressure measuring points. A tubular sub having a side port is supplied for each point. One set of cut line ends is threaded through the sub and reconnected with the other set. A pressure sensor is inserted in the string at the cut point and connected with pressure sensor wiring and the port. This process is repeated along the tubing string. The product is a continuous tubing string housing a plurality of pressure sensor assemblies connected to ports along the string and a plurality of thermocouples operative to measure temperature at points along the string. The pressure sensor assemblies and thermocouples are operative to transmit their measurements through the dry tubing bore to ground surface.

3 Claims, 4 Drawing Sheets

INSTRUMENTATION TUBING STRING ASSEMBLY FOR USE IN WELLBORES

FIELD OF THE INVENTION

The present invention relates to a process for manufacturing a continuous instrumentation tubing string assembly, for insertion into a wellbore. The assembly is used to measure one or more subterranean reservoir conditions, such as downhole pressure and temperature. The invention also relates to the instrumentation tubing string assembly itself.

BACKGROUND OF THE INVENTION

The instrumentation tubing string assembly has been developed in connection with a specific technology—that of recovering oil from a subterranean formation or reservoir using a wellbore having a horizontal segment or leg. It will be described in the context of that type of well, although the assembly can be used in other well configurations as well.

The development in recent years of horizontal well technology has meant that an oil-bearing reservoir having a vertical thickness of, for example, 30 feet can be produced through a wellbore having a horizontal leg extending into the formation perhaps for 1500 feet. The "production interval" has been greatly extended as a result.

It is desirable for the operator of such a well to know whether all or only part of the horizontal leg of the wellbore is actually producing the oil. If only part of the horizontal leg is producing, it is desirable to know where that production is occurring and where it is not. If the fluid is only entering the wellbore over a 50 foot interval commencing 100 feet from the heel of the horizontal leg, the operator needs to know this. It might be possible to rework the well to increase the producing interval.

Establishing a reservoir pressure profile along the length of the horizontal leg will give an indication of where production is occurring; there is a formation pressure drawdown or reduction associated with those intervals where production is occurring.

One conventional way to establish such a pressure profile is to run a pressure logging tool through the leg. However this is expensive and timeconsuming to do and therefore can only be done from time to time. Another way is to position one or more pressure sensors, equipped with a battery and transmitting electronics, along one of the strings in the well. However, these assemblies are exposed to a wet environment (drilling mud, produced fluid and the like) and failures of downhole electronics and batteries are common.

Many of the horizontal wells in Alberta have been completed in formations containing heavy viscous oil—consequently they are involved in the practice of a variety of thermal processes. In general, steam is injected into the reservoir to warm the oil and improve its mobility. The heated oil is then produced.

It is desirable in connection with these wells to establish a temperature profile along the horizontal leg from time to time to monitor the heating process.

This can be done by supplying temperature sensors such as thermocouples or fibre optic devices at various locations along the production string in the horizontal leg and transmitting the measurements to ground surface through wiring or the fibre. However, the sensors are exposed to well fluids and failure is common.

With this background in mind, we set out to develop a system which can be characterized as follows:

- positioning downhole pressure and temperature sensors along the horizontal leg, the sensors being capable of repeatedly measuring reservoir temperature and pressure in real time and transmitting an indication of these measurements through wiring or alternative means to data acquisition equipment at ground surface for recording, thereby eliminating the need for costly and intermittent temperature logging practices;
- housing the sensors in a secure dry environment to minimize failures;
- activating those sensors requiring actuating current, voltage, pressure or the like from ground surface to eliminate the need for downhole batteries;
- providing multiple pressure and temperature measuring sensors and correlating the location of the sensors to the desirable locations in an operator's well;
- avoiding the banding, clamping and strapping which characterize the prior art systems; and
- being able to retrieve the instrumentation assembly from the well without hindering the operation of the well.

SUMMARY OF THE INVENTION

As a beginning point, we chose to house and seal the sensors in a continuous steel tubing string which can be emplaced in the wellbore, usually in conjunction with a separate production tubing string, using conventional coiled tubing string technology. The terms "coiled" or "coilable" are well understood in the industry to denote a relatively small diameter, continuous tubing string which can be transported to a well site on a drum or in a reel, without exceeding highway regulations.

The problem with using such a string is that the pressure sensors need access to the reservoir. Since the string bore is to be dry, these two requirements are contradictory.

The inventive solution, in a specific preferred form, involved the following:

- threading a bundle of sensor instrument lines, such as hard-wired temperature thermocouple sensors and the wiring for pressure sensors, through the bore of the tubing string. This was done at ground surface with the string uncoiled. The thermocouple sensors were staggered, as were the downhole or lower ends of the pressure sensor wiring, so that they would be located at predetermined measurement positions along the lower portion of the string, which would be located in the producing horizontal leg of the wellbore;
- the tubing string and the continuing contained instrument lines were then cut at each pressure-measuring point;
- a tubular steel sub having a port in its side wall was supplied for each cut point;
- at each cut point, a pressure sensor device was connected to its wiring and positioned in the bore of the tubing string adjacent the cut point;
- one set of cut ends of the instrument lines extending past the cut point was threaded through the bore of the sub and reconnected or spliced with the other set of cut ends;
- the pressure sensor was connected with the port in the sub. The sensor was adapted to contain or isolate formation fluid form the tubing string bore;
- the sub was then welded to the cut ends of the tubing string at the cut point;
- this process was repeated at each cut point along the string;
- the lower or toe end of the string was plugged or sealed; and the so-assembled continuous instrumentation tubing string was then coiled on a drum and run into a wellbore. As a consequence of practising this procedure, the following resulted:

the sensors were now sealed in a dry bore;

the sensors had means extending from the production interval up to ground surface, for transmitting signals indicative of the measurements made;

the pressure sensors had access to the exterior reservoir pressure;

multiple pressure and temperature sensors were now appropriately spaced along the length of the horizontal leg segment of the tubing string; and the entire assembly could be run into or out of the wellbore as a unit.

The pressure sensors used in the described embodiment were of a known hard-wired strain gauge type that can be activated by voltage applied from ground surface through wiring to cause the sensor to produce a frequency signal indicative of the pressure at the sensor; this signal is transmitted through signal wiring back to conventional recording means at ground surface. As an alternative, conventional bubble tubes have also been used for pressure sensing. With these devices, nitrogen is introduced into the tube when in the wellbore, to form a continuous column. The pressure required at ground surface to bubble the nitrogen out the downhole end of the tube can be measured. After deducting the head of nitrogen involved, one can derive a value indicative of formation pressure. Both of these known sensors involve activation from ground surface and thus downhole electronics and batteries are eliminated.

Several known temperature sensor assemblies have been successfully used, including hard wired thermocouples and thermistors, and fibre optics. These devices transmit their measurements to ground surface through the wiring or the fibre and do not require downhole electronics or batteries.

The invention is not limited to use with pressure and temperature sensors. For example it is contemplated that salinity sensors or probes could be mounted in the port to access reservoir fluid and measure salinity.

In a broad sense then, we are equipping the instrumentation tubing string with a plurality of permanently positioned sensors comprising:

(a) means for measuring a reservoir condition or characteristic, such as temperature or pressure or salinity, and producing a measurement signal indicative thereof, which could be an electrical signal (voltage, frequency or current), an optical signal, a pressure signal, an electromagnetic signal or a radio frequency signal; and (b) line means for transmitting the signal through the bore of the string to ground surface.

Broadly stated, the invention is an instrumentation tubing string assembly for insertion into a wellbore for measuring a subterranean formation condition at a plurality of spaced apart locations and producing at ground surface signals indicative of the measurements. The assembly includes a continuous coilable tubular tubing string having a bore and upper and lower portions, and the tubing string lower portion includes lengths of tubular tubing sections connected together by tubular subs positioned at spaced apart locations where measurements are to be taken. Each sub has a side wall forming a port and a plurality of sensors are permanently positioned within the tubing string bore. Each sensor is coupled to one of the ports for measuring the reservoir condition at the port and includes means for transmitting signals through the bore of the tubing string to the ground surface. The sensor is operative to contain formation fluid entering through the port and the tubing string includes means sealing its lower end, so that the tubing string bore remains dry.

Broadly stated, in another aspect the invention is directed to a method for constructing an instrumentation tubing string assembly to be inserted into a wellbore for measuring subterranean reservoir pressure and producing signals indicative of said measurements at ground surface, comprising: (a) providing a coilable tubular steel tubing string having a bore, upper and lower portions and upper and lower ends; (b) threading a plurality of lines for transmitting pressure measurement signals into the bore, said plurality of lines having upper and lower ends, the lines' lower ends being spaced apart so that they are landed at pre-determined pressure measurement locations and the lines' upper ends extending to the upper end of the tubing string; (c) cutting the tubing string at a pressure measurement location together with those lines extending past that location to form two tubing string cut ends and two sets of line cut ends; (d) providing a tubular steel sub having a side wall forming a side port; (e) threading one set of line cut ends through the sub and reconnecting them with the corresponding cut ends of the other set; (f) connecting a device for measuring pressure and producing a signal indicative thereof with the line lower end terminating at the cut point and with the sub port, so that there is provided within the tubing string a pressure sensor for measuring pressure at the port and transmitting a signal indicative thereof through the tubing string; (g) welding the sub to the pair of string cut ends; and (h) repeating steps (c)–(g) at each pressure-measuring location to produce a continuous tubing string equipped with a plurality of pressure sensors, each communicating with a port and extending through the bore of the tubing string to its upper end.

DESCRIPTION OF THE DRAWINGS

More specifically, FIG. 5 shows a bundle of instrument lines, comprising temperature thermocouples and pressure sensor wiring, being threaded into the uncoiled tubing string;

FIG. 6 shows the tubing string and lines having been cut and a pressure sensor sub being supplied;

FIG. 7 shows one set of lines cut ends having been threaded through the sub and one end of the sub having been inserted into one cut end of the tubing string, together with a pressure sensor device in the process of being installed;

FIG. 8 shows the sub having been fully installed and welded to the tubing string cut ends;

FIG. 9 shows an instrumentation tubing string assembly after a plurality of subs have been installed.

DESCRIPTION OF THE PREFERRED EMBODIMENT

Figure 1:
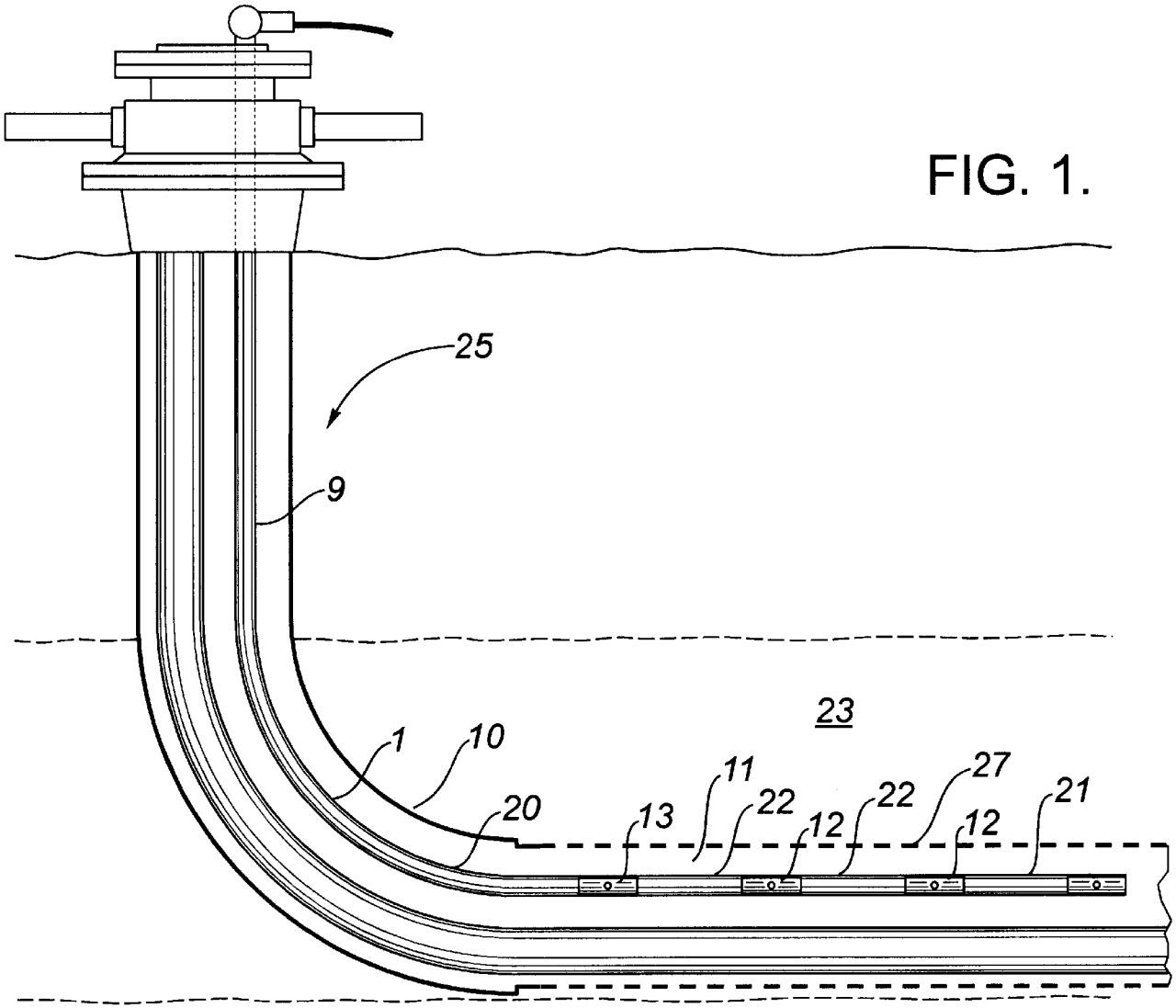
FIG. 1 is a side sectional view showing a continuous instrumentation tubing string assembly and a production string positioned in a wellbore and extending into a slotted liner in the horizontal leg of the wellbore, the instrumentation tubing string assembly comprising a plurality of pressure sensor subs.
Figure 2:
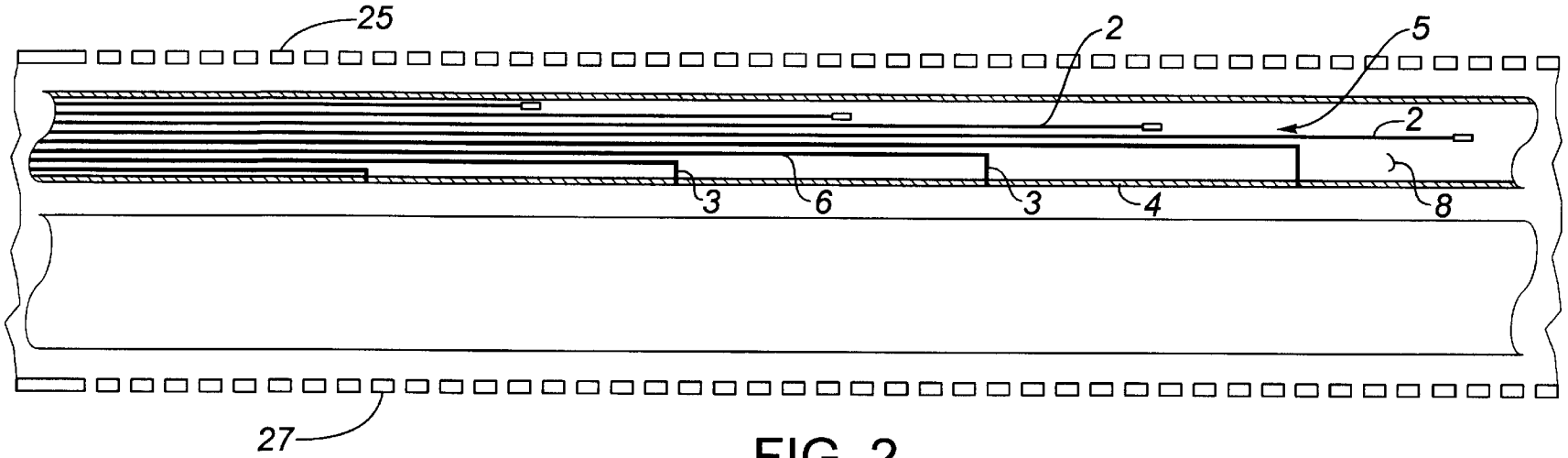
FIG. 2 is a schematic side view showing multiple staggered temperature sensors, including wiring, and multiple staggered pressure sensors, also including wiring, positioned within the bore of an instrumentation tubing string assembly.

Having reference to the Figures, the invention will now be described in terms of an instrumentation tubing string assembly 1 equipped with hard-wired thermocouple sensors 2 and hard-wired pressure sensors 3.

A continuous coiled steel tubing string 4 was supplied and stretched out on the ground.

A bundle 5 of instrumentation lines, comprising hard-wired thermocouple sensors 2 and the wiring 6 for a plurality of pressure sensor devices 7, was formed. The lower ends of the thermocouple sensors 2 were staggered so that they would coincide with pre-determined temperature-measuring locations, when positioned and landed within the tubing string 4. The lower ends of the pressure sensor wiring 6 were also staggered to coincide with pre-determined pressure-measuring locations.

A cable (not shown) was threaded through the bore 8 of the tubing string 4 and used to pull the bundle 5 into place in the bore. The bundle 5 extended from what would be the upper end 9 of the tubing string 4, when in the wellbore 10, to adjacent its lower end 11.

The tubing string 4 was sealed at its lower end by a plug 50, to ensure that the tubing string bore remained dry.

A tubular sub 12 was supplied. The sub 12 had been machined to form a side-opening pressure port 13 and a longitudinally extending passageway 14 connecting therewith. The sub 12 formed a longitudinal bore 15 extending therethrough.

The tubing string 4 was then cut at one of the pressure-measuring points. The hard-wired thermocouple sensors 2 and the wiring 6 for the pressure sensor devices 7, which extended past the cut point, were also cut to form two sets 16, 17 of cut line ends.

One set 17 of cut wiring ends was threaded through the sub bore 15 and reconnected or spliced with the other set 16.

Figure 3:
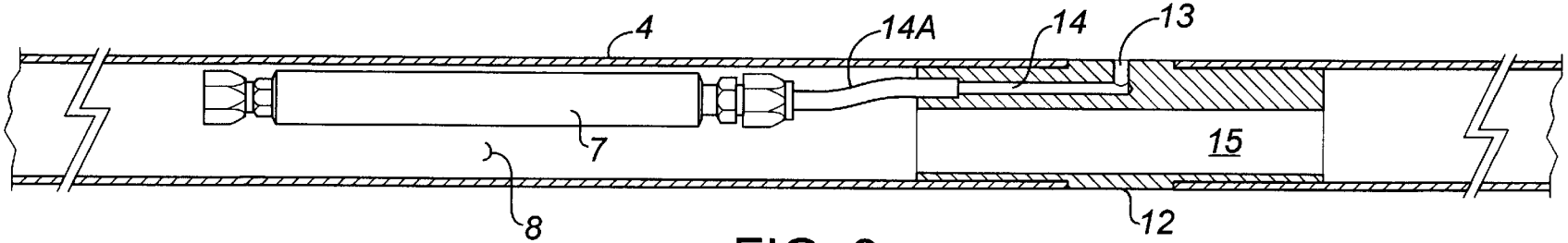
FIG. 3 is a side sectional view of one of the pressure sensor subs of FIG. 1.
Figures 4, 5, 6, 7:
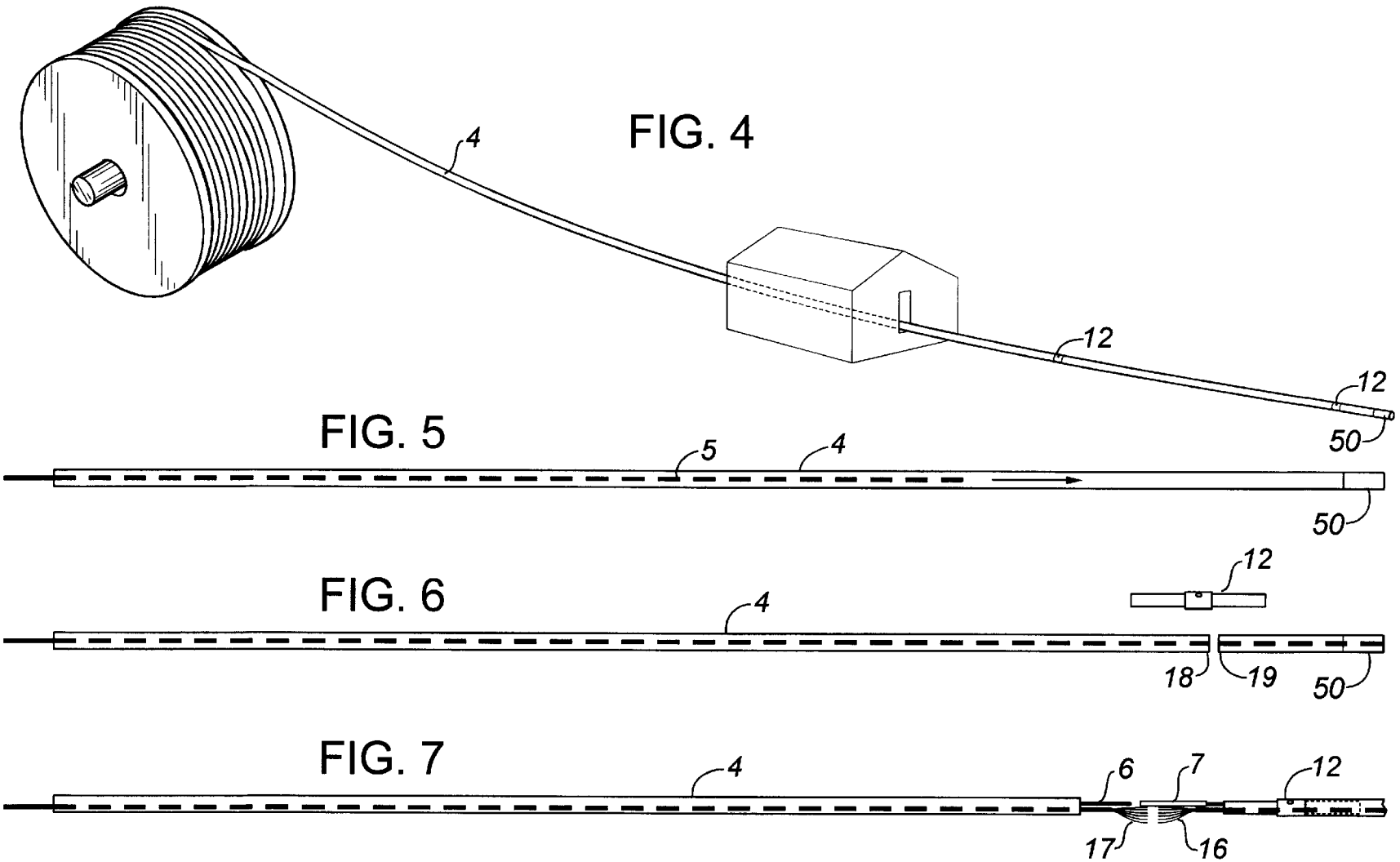
FIG. 4 is a perspective view of a continuous string of coiled tubing being processed at ground surface to add pressure sensor subs.
FIGS. 5–9 are simplified schematic side views showing the manufacturing or assembly process.
Figure 8:
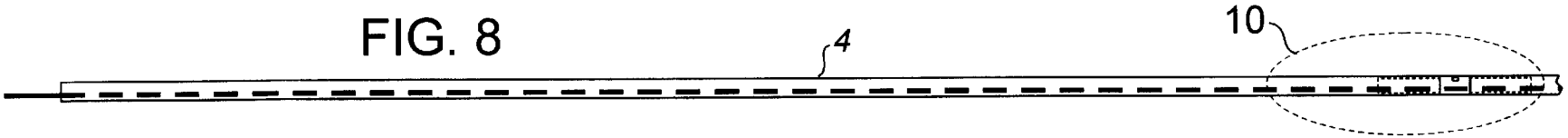
Figure 9:
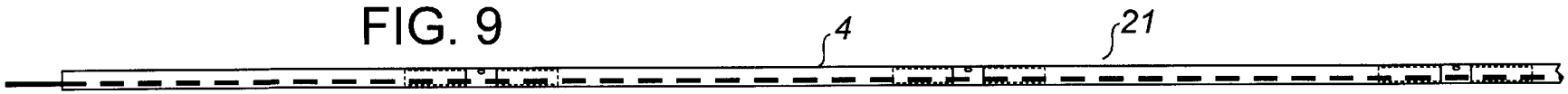
Figure 10:
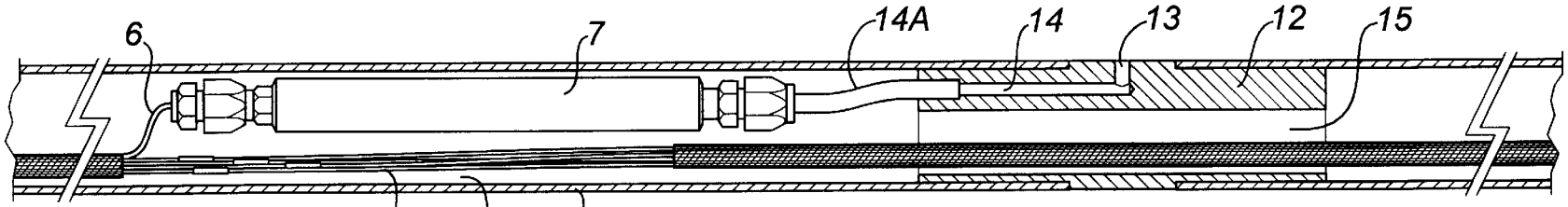
FIG. 10 is a partly sectional side view of the installed pressure sub, bundle and pressure sensor device at A in FIG. 8.

A pressure sensor device 7 was inserted in the tubing string bore 8 adjacent the cut point. The sensor device 7 was connected with the pressure sensor wiring 6 ending at that point. As shown in FIG. 3, the pressure sensor device 7 was also connected by a line 14*a* and sub passageway 14 with the port 13. The pressure sensor formed by the wiring 6, device 7 and the line 14*a* and passageway 14 was thus connected with the port and operative to contain formation fluid entering through the port.

The sub 12 was then welded to the cut ends 18, 19 of the tubing string 4.

This procedure was repeated for each cut point.

The resulting product was an instrumentation tubing string assembly 1. It comprised a continuous steel tubing string 4 having upper and lower portions 20, 21. The lower portion 21 was formed of a plurality of tubular lengths 22 of tubing connected together by a plurality of tubular subs 12. The subs 12 were positioned at spaced apart locations where pressure measurements are to be taken. Each sub 12 had a port 13 for communicating with the reservoir 23. A plurality of hard-wired temperature-measuring thermocouple sensors 2 extended through the bore 8 of the tubing string 4 from its upper end 9. The lower ends of the thermocouple sensors 2 were spaced apart or staggered to coincide with pre-determined temperature measurement locations. A plurality of hard-wired pressure sensors 3 also extended through the bore 8 of the tubing string 4 from its upper end 9. The pressure sensors 3 were operatively connected with the ports 13 at the various pressure measurement locations. Each of the thermocouple and pressure sensors 2, 3 were operative to measure reservoir temperature and pressure, respectively, and produce and transmit signals indicative thereof through the tubing string bore 8 to its upper end.

The instrumentation tubing assembly 1 was now ready to be coiled on a drum (not shown), transported to and run into the wellbore 10 of a well 25 so that the temperature and pressure measuring sensors 2, 3 would be distributed along the horizontal leg 27 of the wellbore 10. When connected with suitable activation and recording means (not shown), temperature and pressure profiles could be produced in real time.

The embodiments of the invention in which an exclusive property or priviledge is claimed are defined as follows:

1. An instrumentation tubing string assembly for insertion into a wellbore for measuring a subterranean formation condition at a plurality of spaced apart locations and producing at ground surface signals indicative of the measurements, comprising:

a continuous coilable tubular tubing string having a bore and upper and lower portions and upper and lower ends, said tubing string lower portion comprising a plurality of lengths of tubular tubing connected together by a plurality of tubular subs positioned in a tubing string bore at spaced apart locations where measurements are to be taken;

each sub having a side wall forming a port;

a plurality of sensors permanently positioned within the tubing string bore, each sensor being connected with one of the ports for measuring the formation condition at the port and having means for transmitting signals indicative thereof through the bore of the tubing string to ground surface;

said sensor being operative to contain formation fluid entering through the port and the tubing string having means sealing its lower end, so that the tubing string bore remains dry.

2. An instrumentation tubing string assembly for insertion into a wellbore for measuring subterranean formation pressure and temperature at a plurality of spaced apart locations and producing at ground surface signals indicative of said measurements, comprising;

a continuous coilable steel tubing string having a bore and upper and lower portions and upper and lower ends, said tubing string lower portion comprising a plurality of lengths of tubular tubing connected together by a plurality of tubular steel subs positioned in a tubing string bore at spaced apart locations where pressure measurements are to be taken;

each sub having a side wall forming a port;

a plurality of pressure sensors permanently positioned within the tubing string bore, each pressure sensor being connected with one of the ports for measuring reservoir pressure at the port and having means for transmitting signals indicative thereof through the bore of the tubing string to ground surface;

a plurality of temperature sensors, permanently positioned within the tubing string bore, for measuring reservoir temperature at spaced apart locations along the tubing string lower portion and having means for transmitting signals indicative thereof through the bore of the tubing string to ground surface;

said pressure sensors being operative to contain formation fluid entering through the ports and the tubing string having means sealing its lower end, so that the tubing string bore remains dry.

3. A testing and measurement system having, in combination:

a wellbore extending from ground surface and penetrating a subterranean formation having conditions of elevated temperature and pressure; and a stationary instrumentation tubing string assembly positioned in the wellbore for measuring formation temperature and pressure at a plurality of spaced apart locations in the formation and transmitting signals indicative of the measurements to ground surface;

said assembly comprising a coilable tubular tubing string having a bore and comprising upper and lower portions and upper and lower ends, said lower portion comprising a plurality of lengths of tubing connected by tubular subs positioned in a tubing string bore at the locations where pressure measurements are to be taken, each sub having a side wall forming a port, a plurality of pressure sensors permanently positioned within the tubing string bore, each pressure sensor being connected with one of the ports for measuring the formation pressure at that port and having means for transmitting signals indicative thereof through the bore of the tubing string to ground surface, a plurality of temperature sensors, permanently positioned within the tubing string bore, for measuring reservoir temperature at spaced apart locations along the tubing string lower portion and having means for transmitting signals indicative thereof through the bore of the tubing string to ground surface, said pressure sensors being operative to contain formation fluid entering through the ports and the tubing string having means sealing its lower end, so that the tubing string bore remains dry.

* * * * *

UNITED STATES PATENT AND TRADEMARK OFFICE

CERTIFICATE OF CORRECTION

PATENT NO. : 6,116,085

DATED : Sep. 12, 2000

INVENTOR(S) : Terry George Moffatt, et al.

It is certified that error appears in the above-indentified patent and that said Letters Patent is hereby corrected as shown below:

Claim 1, lines 32-33, "a tubing string bore" should be changed to -- the tubing string --.

Claim 2, lines 55-56, "a tubing string bore" should be changed to -- the tubing string --.

Claim 3, line 2, "a tubing string bore" should be changed to -- the tubing string --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*